US011150576B2

(12) United States Patent
Wang

(10) Patent No.: US 11,150,576 B2
(45) Date of Patent: Oct. 19, 2021

(54) DEVELOPING CARTRIDGE CAPABLE OF MAINTAINING CONTACTING PRESSURE BETWEEN DEVELOPING ROLLER AND PHOTOSENSITIVE DRUM REGARDLESS OF RESIDUAL AMOUNT OF TONER

(71) Applicant: BROTHER KOGYO KABUSHIKI KAISHA, Nagoya (JP)

(72) Inventor: Yuwen Wang, Nagoya (JP)

(73) Assignee: BROTHER KOGYO KABUSHIKI KAISHA

( * ) Notice: Subject to any disclaimer, the term of this patent is extended or adjusted under 35 U.S.C. 154(b) by 0 days.

(21) Appl. No.: 17/109,378

(22) Filed: Dec. 2, 2020

(65) Prior Publication Data

US 2021/0173326 A1 Jun. 10, 2021

(30) Foreign Application Priority Data

Dec. 4, 2019 (JP) ..... JP2019-219646

(51) Int. Cl.
*G03G 15/08* (2006.01)
*G03G 21/16* (2006.01)
*G03G 21/18* (2006.01)

(52) U.S. Cl.
CPC ..... *G03G 15/087* (2013.01); *G03G 15/0872* (2013.01); *G03G 15/0889* (2013.01); *G03G 15/0896* (2013.01); *G03G 21/1647* (2013.01); *G03G 21/1676* (2013.01); *G03G 21/185* (2013.01); *G03G 21/1821* (2013.01);
(Continued)

(58) Field of Classification Search
CPC ..... G03G 15/087; G03G 15/0872; G03G 15/0889; G03G 15/0896; G03G 2215/0636; G03G 21/1647; G03G 21/1676; G03G 21/821; G03G 21/1825; G03G 21/1842; G03G 21/185; G03G 21/1857; G03G 21/864
See application file for complete search history.

(56) References Cited

U.S. PATENT DOCUMENTS

2002/0018666 A1* 2/2002 Noda ..... G03G 15/757 399/90
2007/0077087 A1 4/2007 Okabe et al.
(Continued)

FOREIGN PATENT DOCUMENTS

JP 2007-101635 A 4/2007
JP 2019-179127 A 10/2019

*Primary Examiner* — Joseph S Wong
(74) *Attorney, Agent, or Firm* — Merchant & Gould P.C.

(57) ABSTRACT

A developing cartridge including a casing, a developing roller, a developing roller gear, a gear cover, a first boss, and a pressure receiving surface. The developing roller is positioned closer to a first end portion of the casing than to a second end portion of the casing in a first direction. The first boss extends in a second direction and is movable together with the casing. The first boss is positioned away from the developing roller in the first direction by a first distance and also positioned away from the developing roller in a third direction. The pressure receiving surface is positioned further from the developing roller than the first boss is from the developing roller in the third direction. The pressure receiving surface is positioned away from the developing roller by the first distance or by a second distance shorter than the first distance.

26 Claims, 10 Drawing Sheets

(52) U.S. Cl.
CPC ..... *G03G 21/1842* (2013.01); *G03G 21/1857* (2013.01); *G03G 21/1864* (2013.01); *G03G 21/1825* (2013.01); *G03G 2215/0636* (2013.01)

(56) References Cited

U.S. PATENT DOCUMENTS

| | | | | |
|---|---|---|---|---|
| 2010/0067947 | A1* | 3/2010 | Yuzawa | G03G 15/0813 399/119 |
| 2018/0046132 | A1* | 2/2018 | Eto | G03G 21/1676 |
| 2019/0302645 | A1 | 10/2019 | Wang et al. | |

* cited by examiner

DEVELOPING CARTRIDGE CAPABLE OF MAINTAINING CONTACTING PRESSURE BETWEEN DEVELOPING ROLLER AND PHOTOSENSITIVE DRUM REGARDLESS OF RESIDUAL AMOUNT OF TONER

CROSS REFERENCE TO RELATED APPLICATION

This application claims priority from Japanese Patent Application No. 2019-219646 filed Dec. 4, 2019. The entire content of the priority application is incorporated herein by reference.

TECHNICAL FIELD

The present disclosure relates to a developing cartridge.

BACKGROUND

There has been known an electro-photographic type image forming apparatus such as a laser printer and an LED printer. The image forming apparatus includes a developing cartridge and a drum cartridge. The drum unit includes a plurality of photosensitive drums. The plurality of developing cartridges are attachable to and detachable from the drum unit. When the plurality of developing cartridges are attached to the drum unit, each developing roller of each developing cartridge is in contact with each photosensitive drum of the drum unit.

The developing cartridge includes a developing roller shaft rotatable together with the developing roller. In a case where the developing cartridge is attached to the drum cartridge, the developing cartridge is pivotally moved relative to the drum cartridge about an axis of the developing roller shaft because of own weight of the developing cartridge. Hence, a position of the developing cartridge relative to the drum unit is fixed.

SUMMARY

In the conventional image forming apparatus, since the developing cartridge is pivotally moved relative to the drum unit in case of the attachment of the developing cartridge to the drum cartridge, contacting pressure between the photosensitive drum of the drum unit and the developing roller of the developing cartridge may be largely changed due to residual amount of toner in the developing cartridge. The large change in contacting pressure between the photosensitive drum and the developing roller may cause insufficient toner adhesion to a sheet in case of image forming operation, leading to generation of voids and color irregularity in an output image.

In view of the foregoing, it is an object of the disclosure to provide a developing cartridge capable of restraining the contacting pressure between the photosensitive drum and the developing roller from being largely changed due to residual amount of the toner in the developing cartridge.

In order to attain the above and other objects, according to one aspect, the disclosure provides a developing cartridge including a casing, a developing roller, a developing roller gear, a gear cover, a first boss, and a pressure receiving surface. The casing is configured to accommodate therein toner and extends in a first direction. The casing has a first end portion in the first direction and a second end portion remote from the first end portion in the first direction. The developing roller is rotatable about a developing axis extending in a second direction different from the first direction. The developing roller is positioned closer to the first end portion than to the second end portion in the first direction. The developing roller has an exposed surface and a non-exposed surface. The exposed surface is positioned at one end portion in a third direction of the developing roller and exposed to an outside of the casing. The non-exposed surface is positioned at another end portion in the third direction of the developing roller and positioned inside the casing. The developing roller gear is rotatable together with the developing roller about the developing axis and positioned at one end portion in the second direction of the developing roller. The gear cover is positioned at one end portion in the second direction of the casing and covers at least a part of the developing roller gear. The first boss is positioned at an outer surface of the gear cover and extends in the second direction and is movable together with the casing. The first boss is configured to support a weight of the developing cartridge. The first boss is positioned away from the developing roller in the first direction by a first distance and also positioned away from the developing roller in the third direction. The pressure receiving surface is positioned further from the developing roller than the first boss is from the developing roller in the third direction. The pressure receiving surface is positioned away from the developing roller by the first distance or by a second distance shorter than the first distance.

According to another aspect, there is provided a developing cartridge including a casing, a developing roller, a developing roller gear, a gear cover, a first boss, and a second boss. The casing is configured to accommodate therein toner and extends in a first direction. The casing has a first end portion in the first direction and a second end portion remote from the first end portion in the first direction. The developing roller is rotatable about a developing axis extending in a second direction different from the first direction. The developing roller is positioned closer to the first end portion than to the second end portion in the first direction, the developing roller has an exposed surface and a non-exposed surface. The exposed surface is positioned at one end portion in a third direction of the developing roller and exposed to an outside of the casing. The non-exposed surface is positioned at another end portion in the third direction of the developing roller and positioned inside the casing. The developing roller gear is rotatable together with the developing roller about the developing axis and positioned at one end portion in the second direction of the developing roller. The gear cover is positioned at one end portion in the second direction of the casing and covers at least a part of the developing roller gear. The first boss is positioned at an outer surface of the gear cover and extends in the second direction and is movable together with the casing. The first boss is configured to support a weight of the developing cartridge. The first boss is positioned away from the developing roller in the first direction and the third direction. The second boss extends in the second direction and is movable together with the casing. The second boss is positioned at a first outer surface positioned at the one end portion in the second direction of the casing. The second boss is positioned further from the developing roller than the first boss is from the developing roller in the first direction and the third direction.

BRIEF DESCRIPTION OF THE DRAWINGS

The particular features and advantages of the embodiment (s) as well as other objects will become apparent from the following description taken in connection with the accompanying drawings, in which.

DETAILED DESCRIPTION

Hereinafter, a developing cartridge according to one embodiment of the present disclosure will be described with reference to the accompanying drawings.

Incidentally, in the following description, longitudinal direction of an end surface of a developing cartridge will be referred to as "first direction". Further, an extending direction of a rotation axis of a photosensitive drum will be referred to as "second direction". Further, a direction of an array of a plurality of photosensitive drums will be referred to as "third direction". The first direction, the second direction, and the third direction are crossing one another, and preferably, are perpendicular to one another.

1. Outline of Image Forming Apparatus

Figure 1:
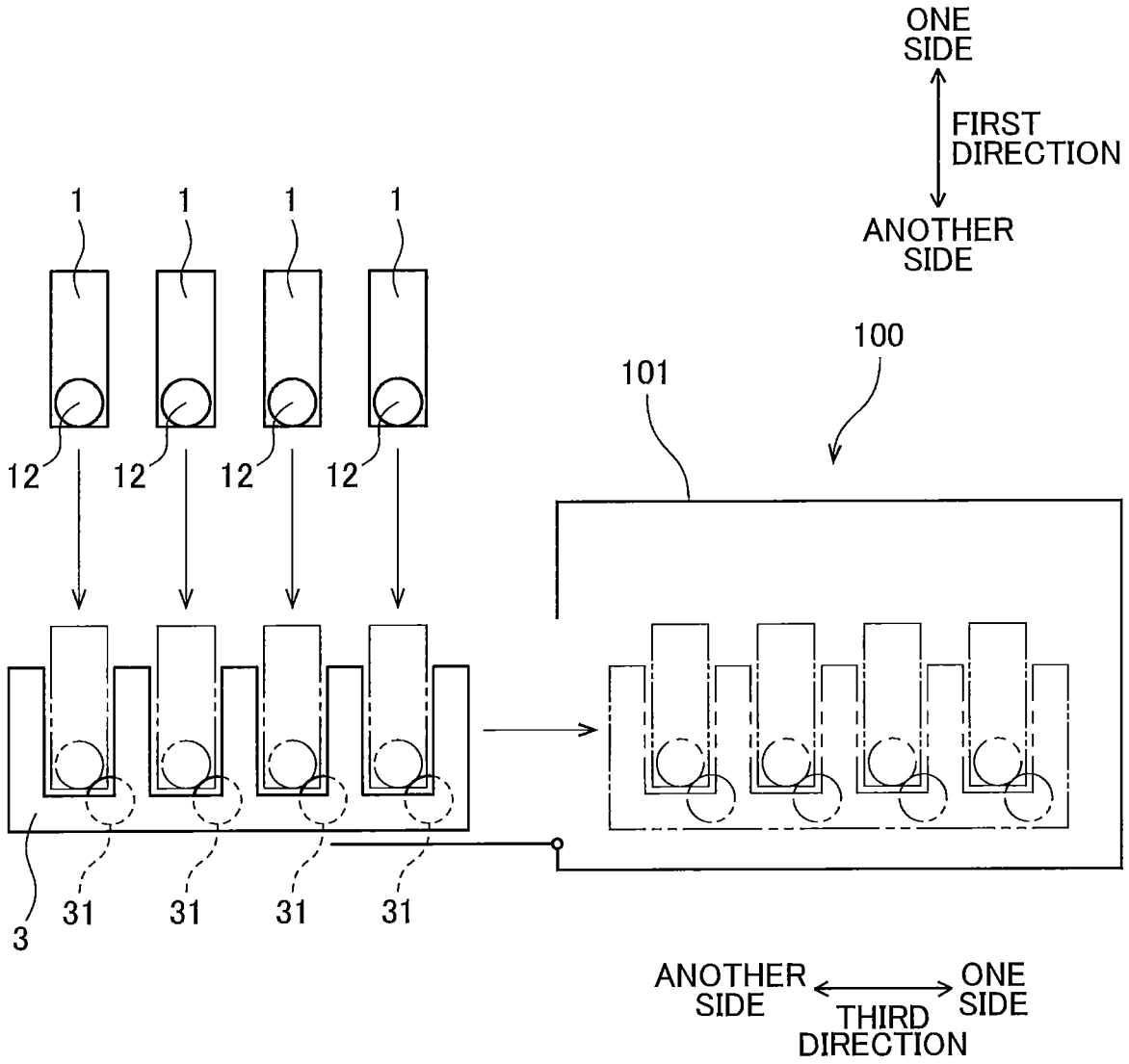
FIG. 1 is a schematic view of an image forming apparatus.

FIG. 1 is a schematic view of an image forming apparatus 100. The image forming apparatus 100 is an electro-photographic type printer such as a laser printer and an LED printer. The image forming apparatus 100 includes a drum unit 3, and a plurality of developing cartridges 1. The drum unit 3 includes a frame configured to hold the plurality of developing cartridges 1.

Figure 2:
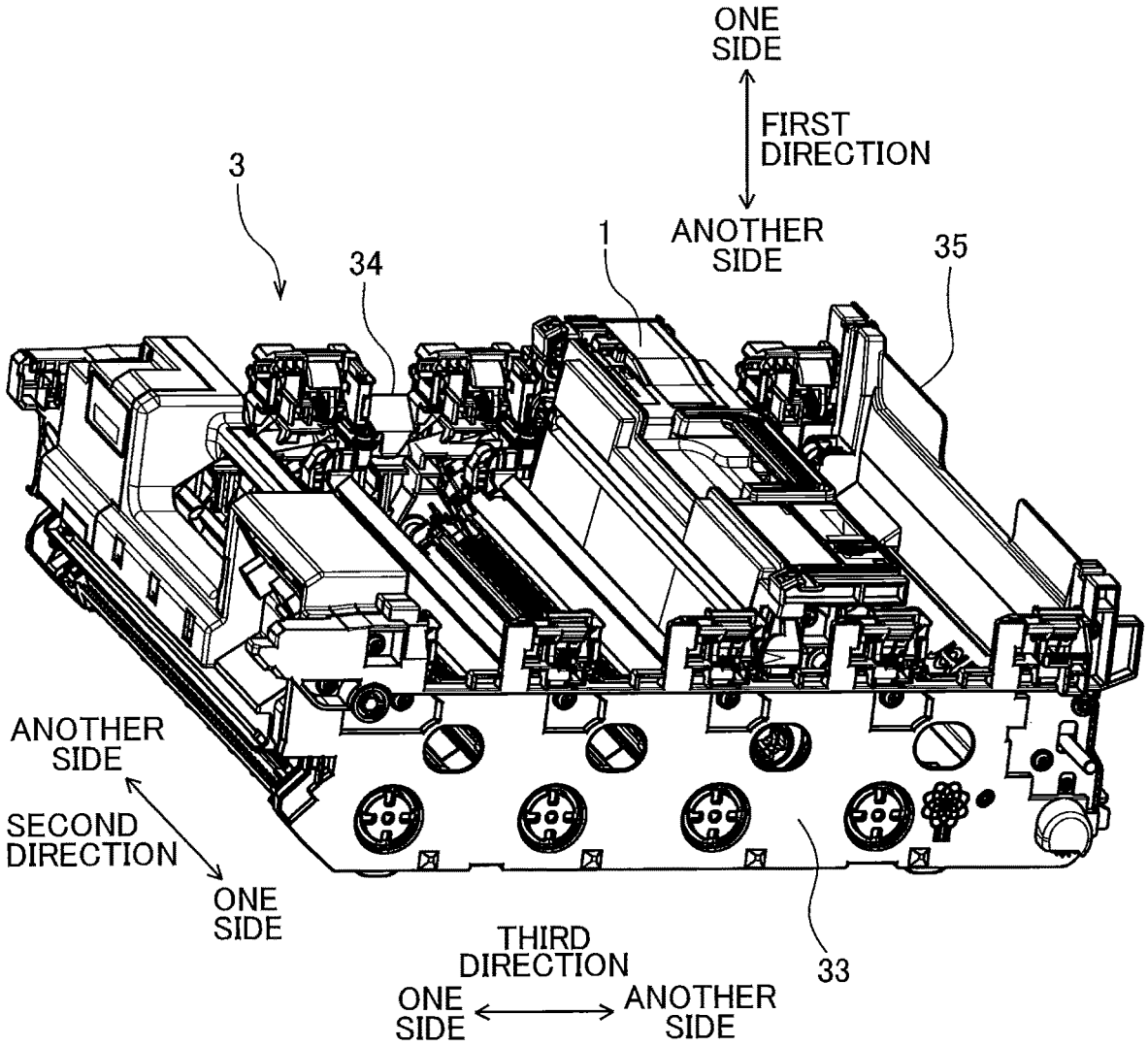
FIG. 2 is a perspective view of a drum unit and a developing cartridge according to one embodiment in the image forming apparatus.

FIG. 2 is a perspective view of the drum unit 3 and a single developing cartridge 1. Each of the plurality of developing cartridges 1 is attachable to the drum unit 3. Further, the drum unit 3 to which the plurality of developing cartridges 1 are attached is attachable to a housing 101 (see FIG. 1) of the image forming apparatus 100. The plurality of developing cartridges 1 accommodate therein toner (developing agent) of different colors, for example, cyan, magenta, yellow, and black, respectively. The image forming apparatus 100 is configured to form or output an image on a recording surface of a sheet by the toner supplied from the plurality of developing cartridges 1. Four developing cartridges 1 are attachable to the drum unit 3. However, from one to three numbers of the developing cartridge, or not less than five developing cartridges may be attached to the drum unit 3.

2. Structure of Developing Cartridge

Figure 3:
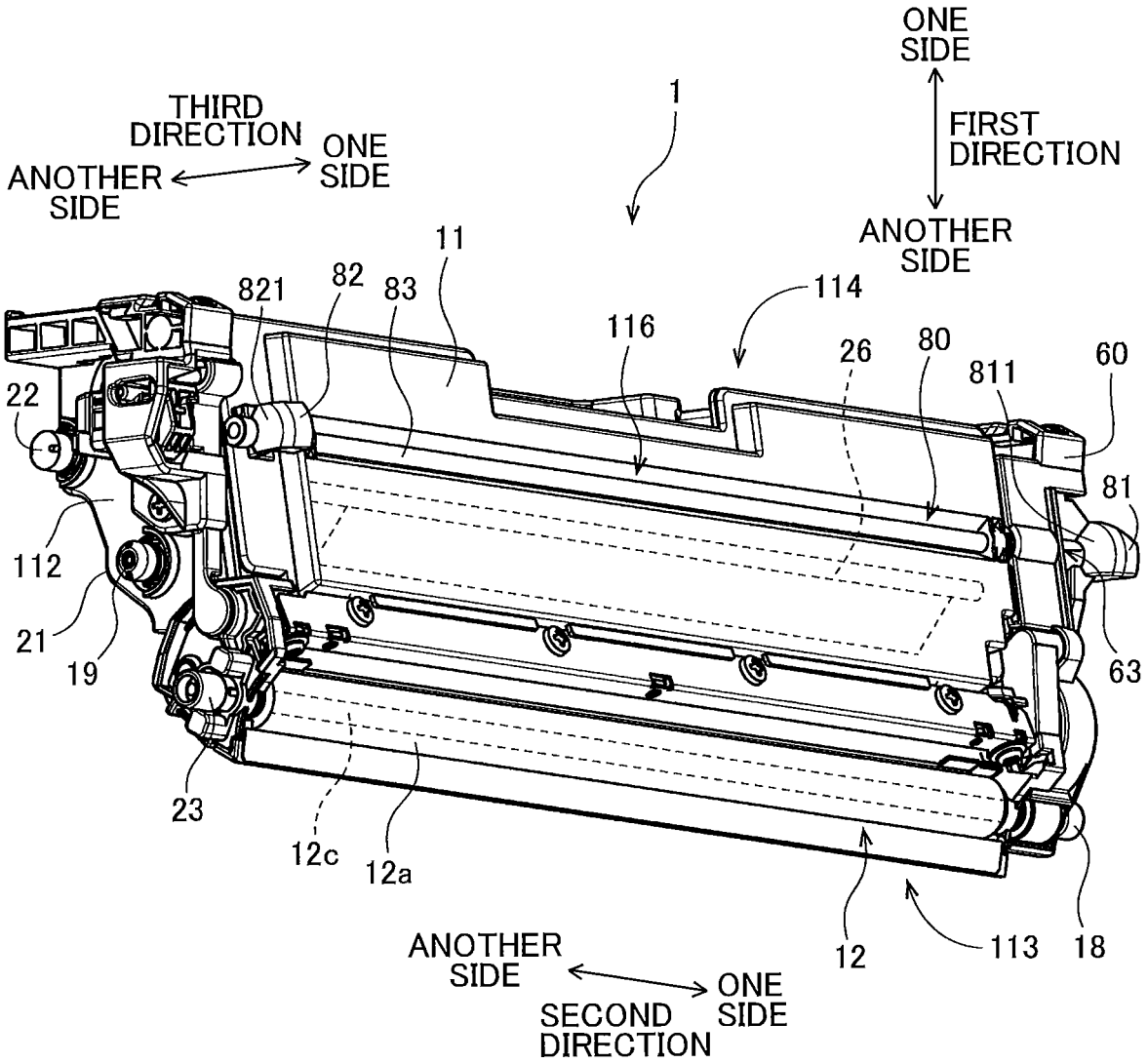
FIG. 3 is a perspective view of the developing cartridge according to the embodiment.
Figure 4:
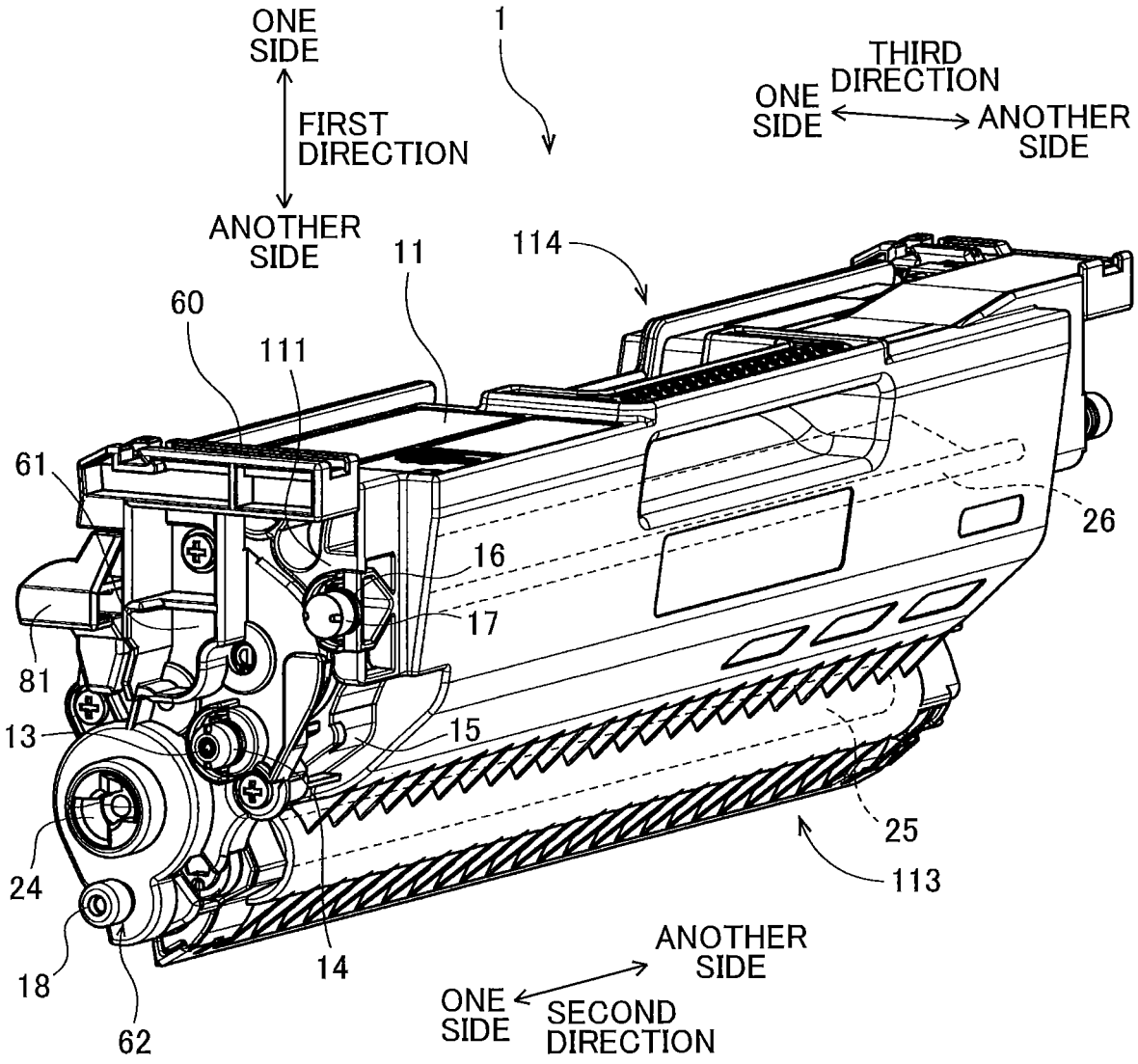
FIG. 4 is another perspective view of the developing cartridge as viewed in a direction different from the viewing direction of FIG. 3.
Figure 5:
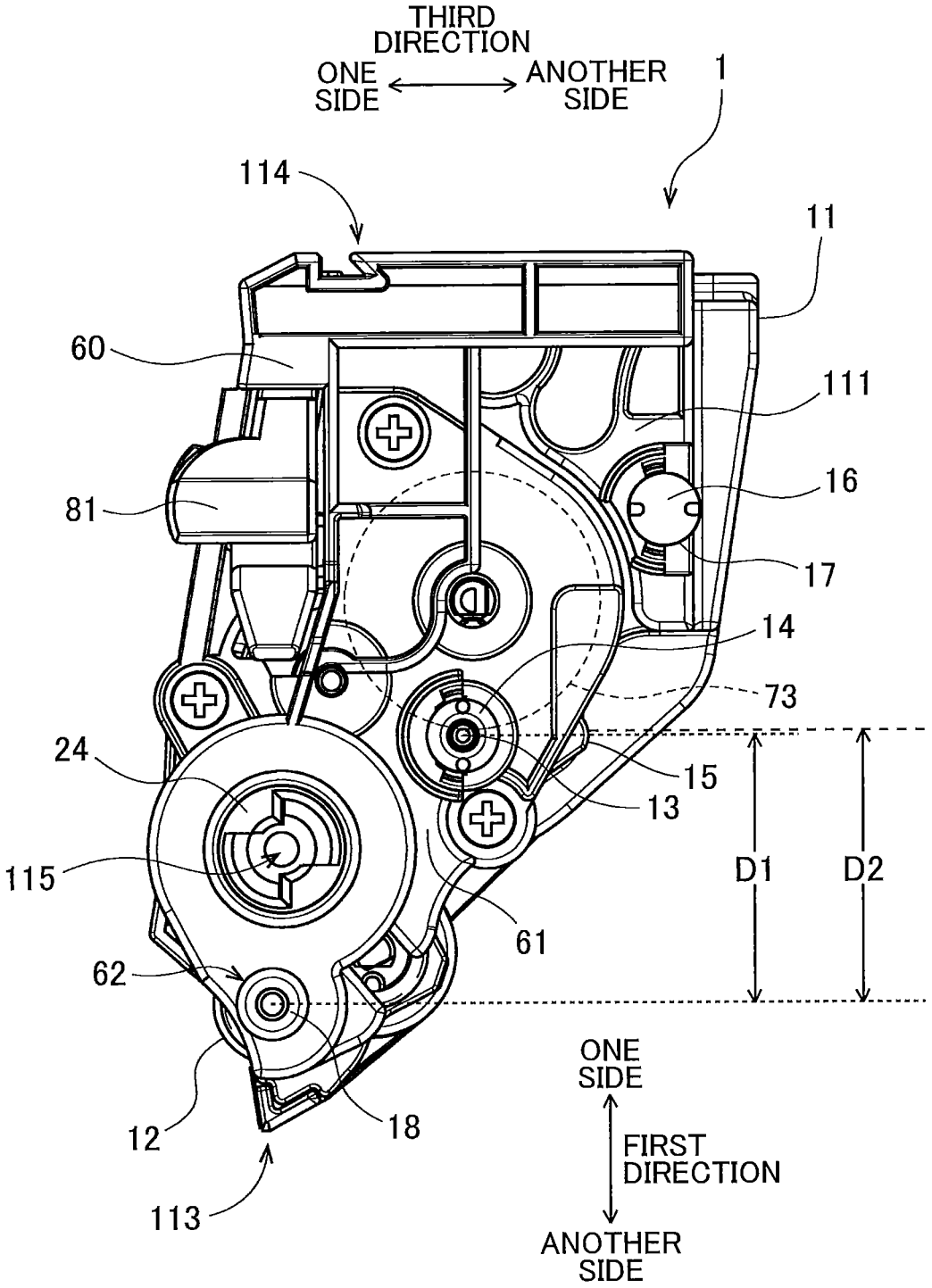
FIG. 5 is a plan view of the developing cartridge as viewed from one side in a second direction.
Figure 6:
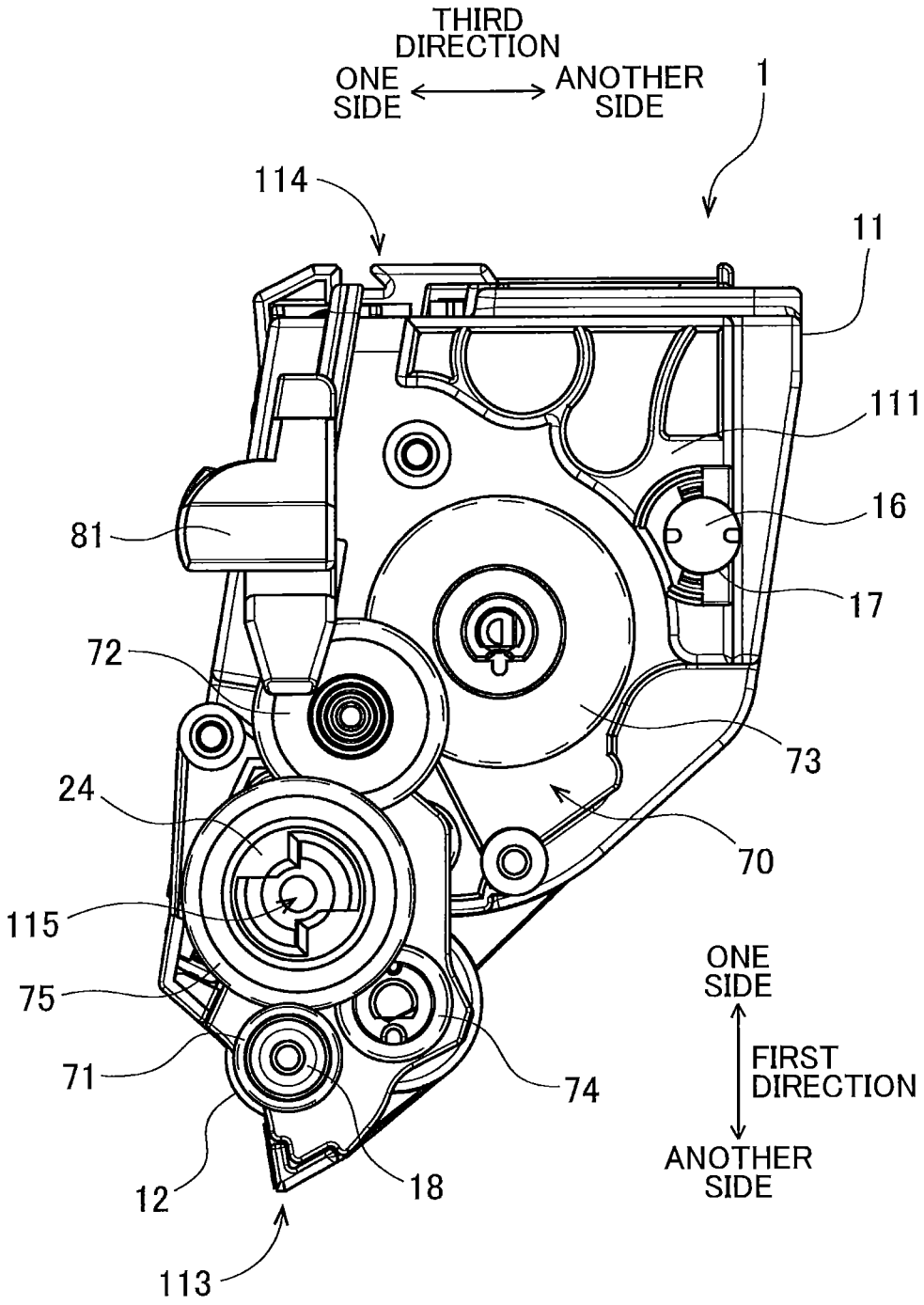
FIG. 6 is a plan view of the developing cartridge as viewed from the one side in a second direction.

FIGS. 3 and 4 are perspective views of the developing cartridge 1. FIGS. 5 and 6 are plan view of the developing cartridge 1 as viewed from one side in the second direction. Here, delineation of a gear cover 60 is omitted in FIG. 6. As illustrated in FIGS. 3 through 6, the developing cartridge 1 according to the embodiment includes a casing 11, a developing roller 12, a supply roller 25, an agitator 26, the gear cover 60, a gear portion 70, and a coupling 24.

The casing 11 is configured to accommodate therein toner. That is, the casing 11 includes an accommodation chamber (not illustrated) for accommodating therein toner. The casing 11 extends in the second direction. The casing 11 has a first outer surface 111 and a second outer surface 112 positioned away from the first outer surface in the second direction. The first outer surface 111 is one end surface in the second direction of the casing 11. Longitudinal direction of the first outer surface 111 is the first direction. The second outer surface 112 is another end surface in the second direction of the casing 11. Longitudinal direction of the second outer surface 112 is the first direction. Further, the casing 11 has a first end portion 113 in the first direction, and a second end portion 114 positioned away from the first end portion 113 in the first direction.

The developing roller 12 is rotatable about a rotation axis (developing axis) extending in the second direction. The developing roller 12 is positioned between the first outer surface 111 and the second outer surface 112 of the casing 11. The developing roller 12 is positioned closer to the first end portion 113 than to the second end portion 114 in the first direction. The developing roller 12 is positioned at one end portion in the third direction of the casing 11. In other words, the casing 11 has one outer surface and another outer surface in the third direction, and the developing roller 12 is positioned at the one outer surface in the third direction of the casing 11. Specifically, the developing roller 12 includes a developing roller body having hollow cylindrical shape, and a developing roller shaft 12*c* having hollow cylindrical shape. The developing roller shaft 12*c* extends through a hollow center of the developing roller body in the second direction. The developing roller shaft 12*c* and the developing roller body are integrally rotatable. Each end portion in the second direction of the developing roller shaft 12*c* is rotatably supported by each end surface of the casing 11. Specifically, one end portion in the second direction of the developing roller shaft 12*c* is rotatably supported by the first outer surface 111 of the casing 11, and another end portion in the second direction of the developing roller shaft 12*c* is rotatably supported by the second outer surface 112 of the casing 11.

The developing roller 12 (the developing roller body) has an exposed surface 12*a* and non-exposed surface (not illustrated). The exposed surface 12*a* is positioned at one side in the third direction of the developing roller 12 and is exposed to an outside of the casing 11. The non-exposed surface is positioned at another side in the third direction of the developing roller 12 and inside the casing 11. An outer peripheral surface of the developing roller 12 is in contact with an outer peripheral surface of a photosensitive drum 31 when the developing cartridge 1 is attached to the drum unit 3.

The supply roller 25 is rotatable about a rotation axis (supply axis) extending in the second direction. The supply roller 25 is positioned inside the casing 11. Specifically, the supply roller 25 is positioned between the first outer surface 111 and the second outer surface 112 of the casing 11 in the second direction. Further, the supply roller 25 is positioned between the developing roller 12 and the agitator 26 in the third direction.

The supply roller 25 includes a supply roller body having hollow cylindrical shape and a supply roller shaft having hollow cylindrical shape. The supply roller shaft extends through a hollow center of the supply roller body in the second direction. The supply roller shaft and the supply roller body are integrally rotatable. Each end portion in the second direction of the supply roller shaft is rotatably supported by each end surface of the casing 11. Specifically, one end portion in the second direction of the supply roller shaft is rotatably supported by the first outer surface 111 of the casing 11, and another end portion in the second direction of the supply roller shaft is rotatably supported by the second outer surface 112 of the casing 11. The supply roller body has an outer peripheral surface in contact with the non-exposed surface of the developing roller body. Toner in the casing 11 is supplied to the developing roller body by way of the supply roller body. The agitator 26 is rotatable about a rotation axis (agitator axis) extending in the second direction. The agitator 26 includes a plurality of agitation blades. The agitator 26 is positioned inside the casing 11. Specifically, the agitator 26 is positioned between the first outer surface 111 and the second outer surface 112 of the casing 11. The agitator 26 is positioned closer to the second end portion 114 than the developing roller 12 is to the second end portion 114 in the first direction. Rotation of the agitator 26 agitates the toner in the accommodation chamber.

The gear cover 60 is positioned at one end portion in the second direction of the casing 11. Specifically, the gear cover 60 is fixed to the first outer surface 111 of the casing 11 by male threads. Hence, the gear cover 60 is immovable relative to the casing 11. That is, the casing 11 and the gear cover 60 are integrally movable. The gear cover 60 covers at least a part of the first outer surface 111. Further, the gear cover 60 has a third outer surface 61. The third outer surface 61 is one end surface in the second direction of the gear cover 60. The third outer surface 61 extends approximately parallel to the first outer surface 111.

The coupling 24 is positioned at the one end portion in the second direction of the casing 11. The coupling 24 is configured to receive driving force supplied from a body of the image forming apparatus 100. The coupling 24 is rotatable about a rotation axis (coupling axis) extending in the second direction. the coupling 24 is positioned closer to the second end portion 114 than the developing roller 12 is to the second end portion 114 in the second direction. The coupling 24 has a recessed portion 115 recessed in the second direction. As a result of attachment of the developing cartridge 1 attached to the drum unit 3 to the housing 101 of the image forming apparatus 100, a drive shaft (not illustrated) provided at the body of the image forming apparatus 100 is inserted in the recessed portion 115. Hence, the drive shaft and the coupling 24 are coupled together without relative rotation. Therefore, rotation of the drive shaft causes rotation of the coupling 24.

The gear portion 70 is positioned at the one end portion in the second direction of the casing 11. Specifically, the gear portion 70 is positioned between the first outer surface 111 of the casing 11 and the gear cover 60. As illustrated in FIG. 6, the gear portion 70 includes a developing roller gear 71, an idle gear 72, an agitator gear 73, a supply roller gear 74, and a coupling gear 75. The coupling gear 75 is rotatable together with the coupling 24 about the coupling axis. The coupling gear 75 may be fixed to the coupling 24. Alternatively, the coupling 24 and the coupling gear 75 are integral with each other as a single component. The gear cover 60 covers at least a part of the coupling gear 75.

The developing roller gear 71 is rotatable together with the developing roller 12 about the developing axis. The developing roller gear 71 is positioned at one end portion in the second direction of the developing roller 12. Specifically, the developing roller gear 71 is fixed to the one end portion in the second direction of the developing roller shaft 12*c*. Further, the developing roller gear 71 is in meshing engagement with the coupling gear 75. Hence, rotation of the coupling 24 causes rotations of the coupling gear 75 and the developing roller gear 71, and accordingly, the developing roller 12 rotates by the rotation of the developing roller gear 71. The gear cover 60 covers at least a part of the developing roller gear 71.

The idle gear 72 is rotatable about a rotation axis (idle axis) extending in the second direction. The idle gear 72 is in meshing engagement with the coupling gear 75. Hence, rotation of the coupling 24 causes rotations of the coupling gear 75 and the idle gear 72. The gear cover 60 covers at least a part of the idle gear 72.

The agitator gear 73 is rotatable together with the agitator 26 about the agitator axis. The agitator gear 73 is positioned at one end portion in the second direction of the agitator 26. Specifically, the agitator gear 73 is fixed to the one end portion in the second direction of the agitator 26. Further, the agitator gear 73 is in meshing engagement with the idle gear 72. Hence, rotation of the coupling 24 causes rotations of the coupling gear 75 and the idle gear 72 to rotate the agitator gear 73. Accordingly, the agitator 26 rotates by the rotation of the agitator gear 73. The gear cover 60 covers at least a part of the agitator gear 73.

The supply roller gear 74 is rotatable together with the supply roller 25 about the supply axis. The supply roller gear 74 is positioned at one end portion in the second direction of the supply roller 25. Specifically, the supply roller gear 74 is fixed to one end portion in the second direction of the supply roller shaft. Further, the supply roller gear 74 is in meshing engagement with the coupling gear 75. Hence, rotation of the coupling 24 causes rotations of the coupling gear 75 and the supply roller gear 74, and accordingly, the supply roller 25 rotates by the rotation of the supply roller gear 74. The gear cover 60 covers at least a part of the supply roller gear 74.

3. Structure of Drum Unit

Figure 7:
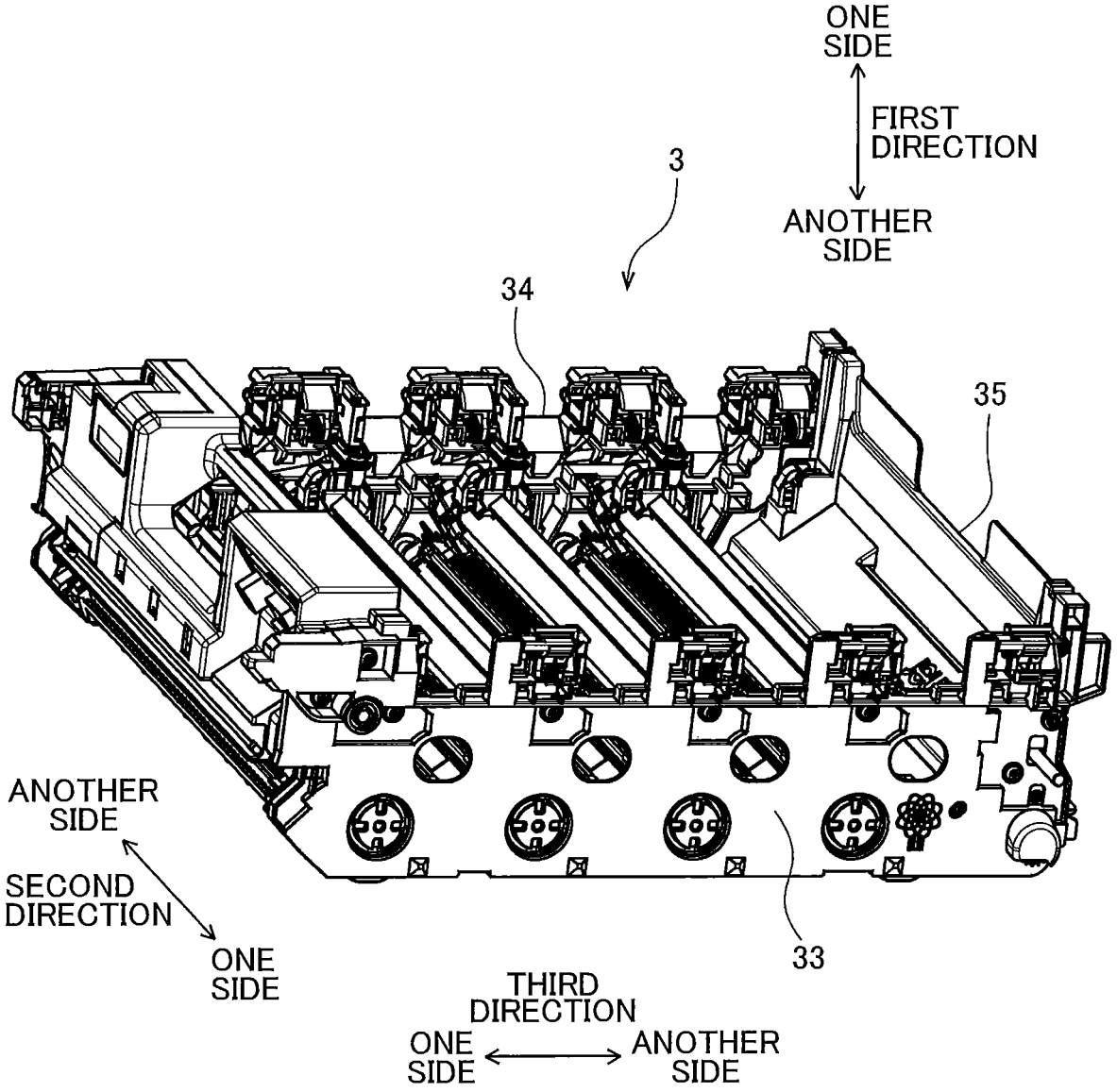
FIG. 7 is a perspective view of the drum unit.
Figure 8:
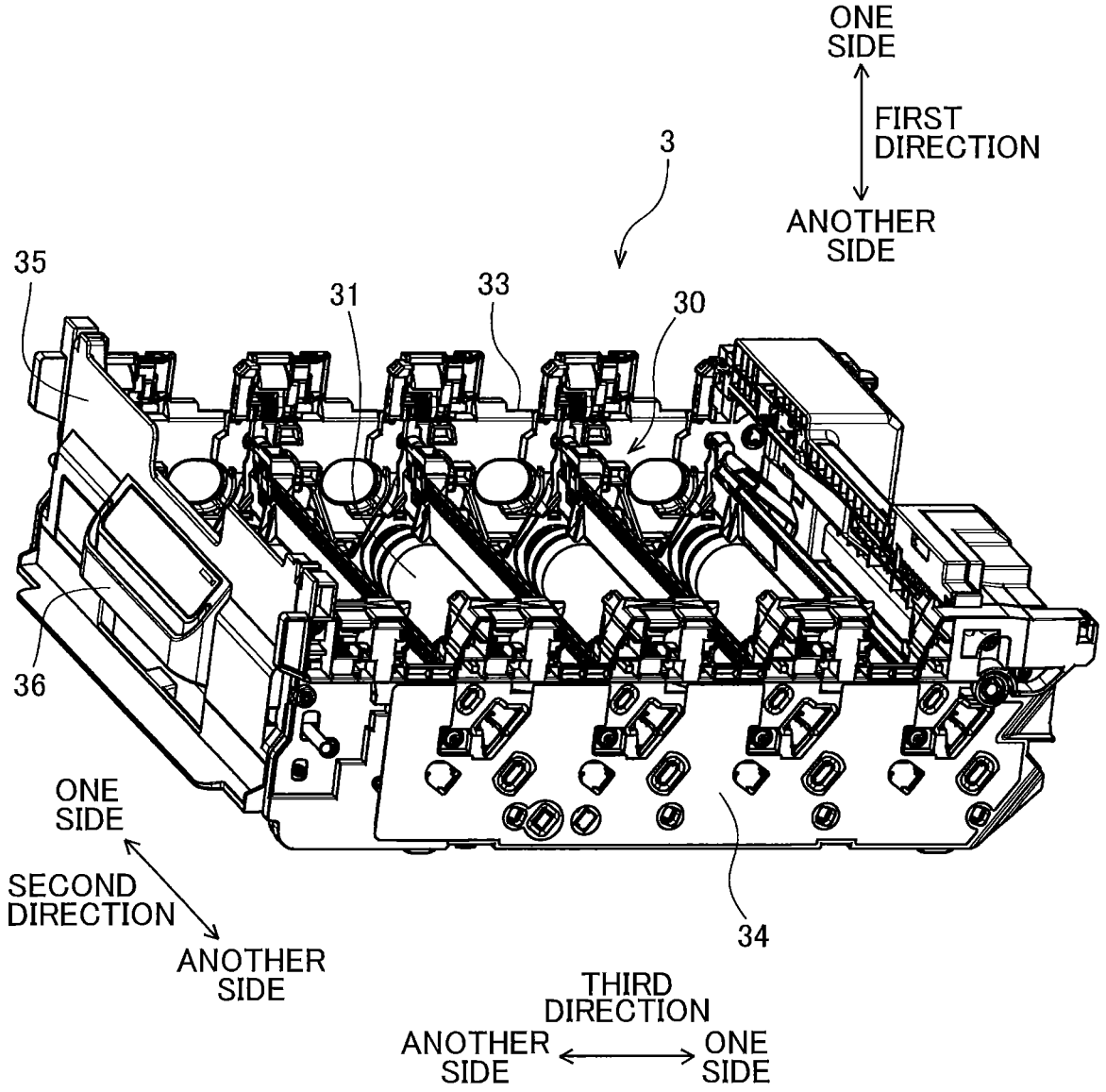
FIG. 8 is another perspective view of the drum unit as viewed in a direction different from the viewing direction of FIG. 7.

Next, a structure of the drum unit 3 will be described. FIGS. 7 and 8 are perspective views of the drum unit 3.

As illustrated in FIGS. 7 and 8, the drum unit 3 includes a plurality of the photosensitive drums 31, a first side plate 33, a second side plate 34, and a drawer plate 35. Four photosensitive drums 31 are provided in the present embodiment.

The photosensitive drum 31 is configured to transfer toner supplied from the developing cartridge 1 to the sheet. The plurality of the photosensitive drums 31 are arrayed in the third direction with an interval between neighboring photosensitive drums. Each photosensitive drum 31 has a cylindrical outer peripheral surface extending in the second direction. The outer peripheral surface of the photosensitive drum 31 is coated with a photosensitive material. Further, the photosensitive drum 31 is rotatable about a rotation axis extending in the second direction.

The first side plate 33, the second side plate 34 and the drawer plate 35 constitute in combination a frame configured to hold the plurality of photosensitive drums 31. The frame has an open end at one end in the first direction of the frame. The one end is positioned backward of an opposite end which is positioned further in a gravitational direction than the one end is in a gravitational direction.

The first side plate 33 is configured to support one end portion in the second direction of the photosensitive drum 31. The first side plate 33 extends in a direction perpendicular to the second direction. The first side plate 33 extends in the third direction. The first side plate 33 is plate shaped. The first side plate 33 includes a plurality of (four in the embodiment) developing cartridge holders 30. Each developing cartridge holder 30 is positioned at an inner side surface in the second direction of the first side plate 33. The developing cartridge holders 30 are arrayed in the third direction with an interval between neighboring developing cartridge holders 30. One end portion in the second direction of the developing cartridge 1 (the one end portion has the first outer surface 111) is held by the developing cartridge holder 30 of the first side plate 33.

The second side plate 34 is configured to support another end portion in the second direction of the photosensitive drum 31. The second side plate 34 extends in a direction perpendicular to the second direction. The second side plate 34 extends in the third direction. The second side plate 34 is plate shaped. The second side plate 34 includes a plurality of (four in the embodiment) developing cartridge holders (not illustrated). Each developing cartridge holder is positioned at an inner side surface in the second direction of the second side plate 34. Numbers of the developing cartridge holders of the second side plate 34 is equal to the numbers of the developing cartridge holder 30 of the first side plate 33. The other end portion in the second direction of the developing cartridge 1 (the other end portion has the second outer surface 112) is held by the developing cartridge holder of the second side plate 34.

The drawer plate 35 connects another end portion in the third direction of the first side plate 33 to another end portion in the third direction of the second side plate 34. The drawer plate 35 extends in a direction perpendicular to the third direction. The drawer plate 35 extends in the second direction. The drawer plate 35 is plate shaped. The drawer plate 35 has a handle 36. The handle 36 is positioned at an outer side surface in the third direction of the drawer plate 35. The handle 36 is configured to be gripped by a user to pull the drum unit 3 out of the housing 101 or to push the drum unit 3 in the housing 101.

The developing cartridge 1 is attached to the drum unit 3 in a case where the one end portion in the second direction of the developing cartridge 1 is held by the developing cartridge holder 30 of the first side plate 33, and the other end portion in the second direction of the developing cartridge 1 is held by the developing cartridge holder of the second side plate 34. When the developing cartridge 1 is attached to the drum unit 3, the outer peripheral surface (the exposed surface 12*a*) of the developing roller 12 is in contact with the outer peripheral surface of the photosensitive drum 31.

According to the image forming apparatus 100 thus constructed, an image is formed on the sheet by the following manner. That is, in accordance with rotations of the coupling 24 and the photosensitive drum 31, toner is supplied from the toner accommodation chamber of the casing 11 to the outer peripheral surface of the photosensitive drum 31 through the developing roller 12. At that time, toner carried on the outer peripheral surface of the developing roller 12 is transferred from the developing roller 12 to the photosensitive drum 31 in conformance with an electrostatic latent image formed on the outer peripheral surface of the photosensitive drum 31. As a result, the electrostatic latent image becomes a visible image on the outer peripheral surface of the photosensitive drum 31. Then, the toner is transferred from the photosensitive drum 31 to the sheet.

4. Attachment/Detachment Structure

Figure 9:
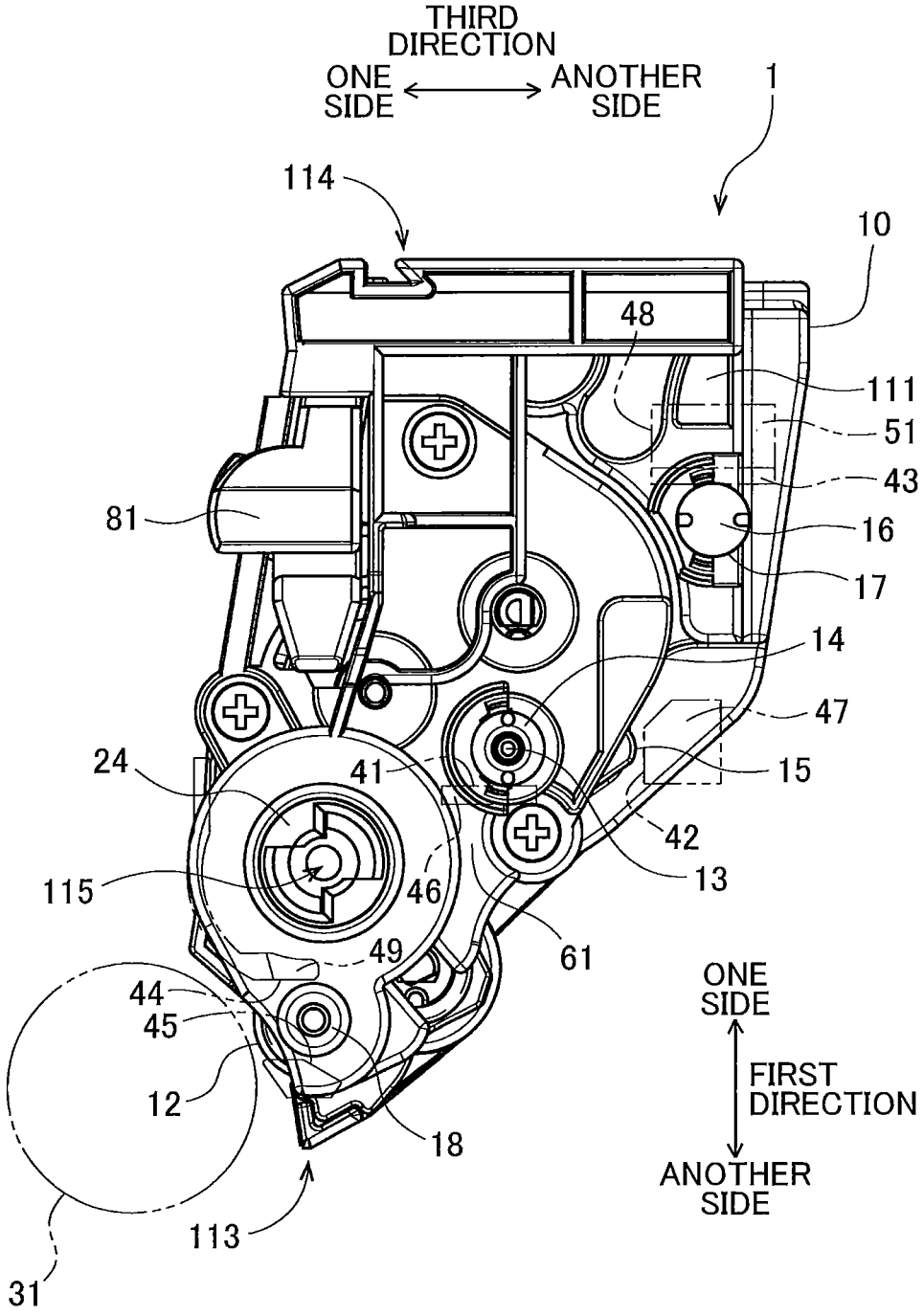
FIG. 9 is a plan view of the developing cartridge as viewed from the one side in the second direction when the developing cartridge is attached to the drum unit.
Figure 10:
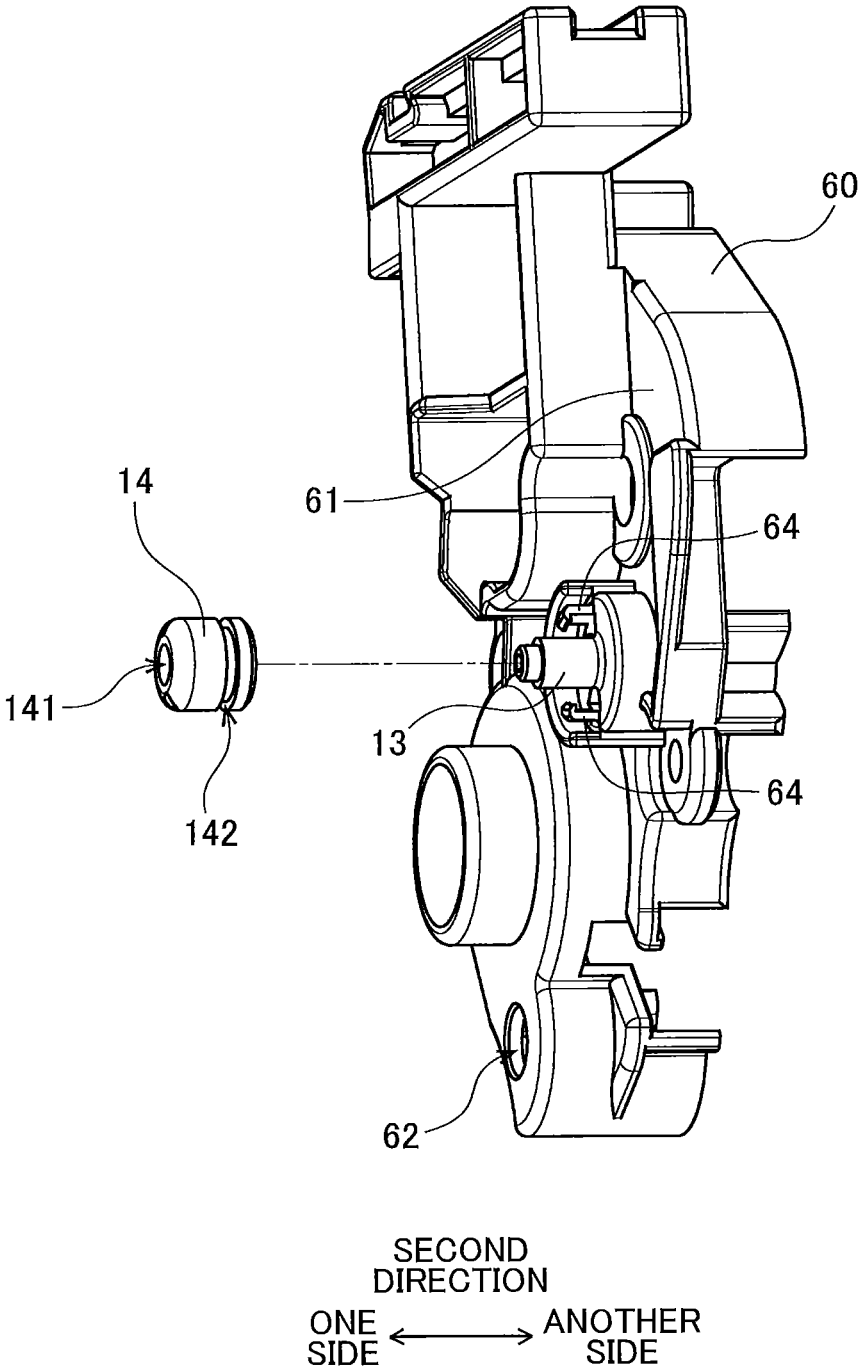
FIG. 10 is an exploded perspective view of a gear cover and a first collar in the developing cartridge.

A structure for attaching and detaching the developing cartridge 1 to and from the drum unit 3 will be described with reference to FIGS. 3 through 10. FIG. 9 is a view of the developing cartridge 1 as viewed from one side in the second direction when the developing cartridge 1 is attached to the drum unit 3. FIG. 10 is an exploded perspective view of the gear cover 60 and a first collar 14. The developing cartridge 1 according to the present embodiment includes a first boss 13, the first collar 14, a first pressure receiving surface 15, a second boss 16, a second collar 17, a first developing collar 18, a third boss 19, a second pressure receiving surface 21, a fourth boss 22, and a second developing collar 23.

The first boss 13 extends in the second direction. The first boss 13 according to the present embodiment is a member separate from the gear cover 60. The first boss 13 is fixed to the gear cover 60. However, the first boss 13 may be formed integrally with the gear cover 60. The first boss 13 is movable together with the casing 11 and the gear cover 60. The first boss 13 is positioned at the third outer surface 61 of the gear cover 60. Specifically, the first boss 13 protrudes from the third outer surface 61 of the gear cover 60 toward one side in the second direction. That is, the first boss 13 protrudes from the third outer surface 61 of the gear cover 60 in the second direction away from the casing 11. As described later in detail, the first boss 13 is configured to support a weight of the developing cartridge 1. The first boss 13 is positioned remote from the developing roller 12 in the first direction as well as in the third direction. As described later in detail, the first boss 13 is supported by a support surface 41 (described later) of the drum unit 3 when the developing cartridge 1 is attached to the drum unit 3.

As described above, the first boss 13 is positioned at the third outer surface 61 of the gear cover 60. Therefore, a broad space can be provided between the casing 11 and the gear cover 60 for layout of the plurality of gears in comparison with a situation where the first boss 13 is positioned at the first outer surface 111 of the casing 11. Specifically, in an example illustrated in FIG. 5, a part of the first boss 13 and a part of the agitator gear 73 are overlapped with each other in the second direction. In this manner, at least the part of the first boss 13 and at least a part of the plurality of gears can be overlapped with each other in the second direction. Hence, flexibility in the design of the gear portion 70 can be increased.

The first collar 14 is rotatable about the first boss 13 and is hollow cylindrical. As illustrated in FIG. 10, the first collar 14 has a hollow portion 141. The first boss 13 is inserted in the hollow portion 141. Further, an outer peripheral surface of the first collar 14 has an annular engagement groove 142. On the other hand, the gear cover 60 has two pawl portions 64. The two pawl portions 64 are positioned at radially outer side of the first boss 13. Each of the pawl portions 64 extends from the third outer surface 61 of the gear cover 60 in the second direction toward one side (away from the second outer surface 112). Further, each tip end portion of each pawl portion 64 is bent radially inward toward the first boss 13. Each tip end portion of each pawl portion 64 is engaged with the annular engagement groove 142 upon attachment of the first collar 14 to the first boss 13. This engagement prevents the first collar 14 from releasing from the gear cover 60. Further, the first collar 14 is configured to rotate relative to the first boss 13 while a position in the second direction of the first collar 14 is fixed by the two pawl portions 64.

Note that only a single pawl portions 64 may extend from the gear cover 60. Alternatively, not less than three pawl portions 64 may extend from the gear cover 60. Further, instead of the hollow cylindrical shape of the first collar 14, a polygonal tubular shape is available as a shape of the first collar 14. Further, the first collar 14 may be omitted from the developing cartridge 1. In the latter case, an outer peripheral surface of the first boss 13 may be equivalent to the first collar.

The first pressure receiving surface 15 is an arcuate surface whose center of radius extends in the second direction. The first pressure receiving surface 15 is positioned forward of the first outer surface 111 toward another side in the second direction (in a direction from the first outer surface 111 to the second outer surface 112 in the second direction). The first pressure receiving surface 15 is positioned farther from the developing roller 12 than the first boss 13 is from the developing roller 12 in the third direction. The first pressure receiving surface 15 is positioned at another end portion in the third direction of the casing 11 (the first pressure receiving surface 15 is positioned opposite to the developing roller 12). In other words, the first pressure receiving surface 15 is positioned at another outer surface in the third direction of the casing 11.

The first boss 13 is positioned away from the developing roller 12 in the first direction by a first distance D1. On the other hand, the first pressure receiving surface 15 is positioned away from the developing roller 12 in the first direction by the first distance D1 or by a second distance D2 shorter than the first distance D1 (D2≤D1). As illustrated in FIGS. 5 and 6, according to the present embodiment, the distance from the first pressure receiving surface 15 to the developing roller 12 in the first direction is approximately equal to the first distance D1.

Here, the first distance D1 can be defined by the distance in the first direction between the outer peripheral surface of the first boss 13 and the outer peripheral surface of the developing roller 12, and the second distance D2 can be defined by the distance in the first direction between the outer surface of the first pressure receiving surface 15 and the outer peripheral surface of the developing roller 12. However, this definition is not limiting.

For example, as shown in FIG. 5, the first distance D1 may be defined by the distance in the first direction between a center axis of the first boss 13 and the rotation axis of the developing roller 12, and the second distance D2 may be defined by the distance in the first direction between the center of radius of the arcuate surface of the first pressure receiving surface 15 and the rotation axis of the developing roller 12. Alternatively, the first distance D1 may be defined by the distance in the first direction between the outer peripheral surface of the first boss 13 and the outer peripheral surface of the developing roller shaft 12*c* of the developing roller 12 and the second distance D2 may be defined by the distance in the first direction between the outer peripheral surface of the first pressure receiving surface 15 and the outer peripheral surface of the developing roller shaft 12*c*.

The second boss 16 extends in the second direction. The second boss 16 according to the present embodiment is a member separate from the casing 11. The second boss 16 is fixed to the casing 11. However, the second boss 16 may be formed integrally with the casing 11. The second boss 16 is movable together with the casing 11. The second boss 16 is positioned at the first outer surface 111. Specifically, the second boss 16 protrudes from the first outer surface 111 toward one side in the second direction. That is, the second boss 16 protrudes from the first outer surface 111 in the second direction away from the casing 11. The second boss 16 is positioned farther from the developing roller 12 than the first boss 13 is from the developing roller 12 in the first direction as well as in the third direction. In other words, the second boss 16 and the developing roller 12 are positioned on opposite sides of the first boss 13 with respect to the first direction. Further, the second boss 16 and the developing roller 12 are positioned on opposite sides of the first boss 13 with respect to the third direction. As described later in detail, the second boss 16 is configured to receive pressing force directing from the second end portion 114 to the first end portion 113 in the first direction in case of attachment of the developing cartridge 1 to the drum unit 3.

The second collar 17 is rotatable about the second boss 16 and is hollow cylindrical. The second collar 17 has a hollow portion. The second boss 16 is inserted in the hollow portion. Further, instead of the hollow cylindrical shape of the second collar 17, a polygonal tubular shape is available as a shape of the second collar 17. Further, the second collar 17 may be omitted from the developing cartridge 1. In the latter case, an outer peripheral surface of the second boss 16 may be equivalent to the second collar.

The first developing collar 18 extends in the second direction. The first developing collar 18 is positioned at one end portion in the second direction of the developing roller 12. Specifically, the first developing collar 18 is positioned at the one end portion in the second direction of the developing roller shaft 12*c*. The first developing collar 18 is a member separate from the developing roller 12, and is attached to the developing roller 12. More specifically, the first developing collar 18 is the member separate from the developing roller shaft 12*c*, and is attached to the developing roller shaft 12*c*. To be more specific, the first developing collar 18 is a hollow cylindrical member, and is fitted with the developing roller shaft 12*c*. As an alternative, the first developing collar 18 may be formed integrally with the developing roller 12. More specifically, the first developing collar 18 may be formed integrally with the developing roller shaft 12*c*. As illustrated in FIGS. 4 and 5, the gear cover 60 has a shaft opening 62. The shaft opening 62 is a through-hole extending throughout a thickness of the gear cover 60 in the second direction. The developing roller shaft 12*c* is inserted in the shaft opening 62. One end portion in the second direction of the developing roller shaft 12*c* is positioned forward of the gear cover 60 toward one side in the second direction. The first developing collar 18 is fitted with the one end portion in the second direction of the developing roller shaft 12*c*. That is, the first developing collar 18 is positioned at the third outer surface 61 of the gear cover 60. As described later in detail, the first developing collar 18 is configured to contact a guide 49 of the drum unit 3 when the developing cartridge 1 is attached to the drum unit 3, and functions as a positioning member for fixing a position of the developing cartridge 1 relative to the drum unit 3.

The third boss 19 extends in the second direction. The third boss 19 according to the present embodiment is a member separate from the casing 11, and is fixed to the casing 11. However, the third boss 19 may be formed integrally with the casing 11. The third boss 19 is movable together with the casing 11. The third boss 19 is positioned at the second outer surface 112. Specifically, the third boss 19 protrudes from the second outer surface 112 toward another side in the second direction. That is, the third boss 19 protrudes from the second outer surface 112 in the second direction away from the casing 11. The third boss 19 is positioned on the axis of the first boss 13 extending in the second direction. As will be described later in detail, the third boss 19 is configured to support the weight of the developing cartridge 1 in cooperation with the first boss 13. Incidentally, the developing cartridge 1 includes a collar rotatable about the third boss 19 in a manner the same as the first collar 14.

The second pressure receiving surface 21 is an arcuate surface whose center of radius extends in the second direction. The second pressure receiving surface 21 is positioned away from the first pressure receiving surface 15 in the second direction. The second pressure receiving surface 21 is positioned forward of the second outer surface 112 toward one side in the second direction (in a direction from the second outer surface 112 to the first outer surface 111 in the second direction). The second pressure receiving surface 21 is overlapped with the first pressure receiving surface 15 in the second direction. That is, the second pressure receiving surface 21 is positioned farther from the developing roller 12 than the third boss 19 is from the developing roller 12 in the third direction.

The third boss 19 is positioned away from the developing roller 12 in the first direction by the first distance D1. On the other hand, the second pressure receiving surface 21 is positioned away from the developing roller 12 in the first direction by the first distance D1 or by the second distance D2 shorter than the first distance D1 (D2≤D1).

The fourth boss 22 extends in the second direction. The fourth boss 22 according to the present embodiment is a member separate from the casing 11, and is fixed to the casing 11. However, the fourth boss 22 may be formed integrally with the casing 11. The fourth boss 22 is movable together with the casing 11. The fourth boss 22 is positioned at the second outer surface 112. Specifically, the fourth boss 22 protrudes from the second outer surface 112 toward another side in the second direction. That is, the fourth boss 22 protrudes from the second outer surface 112 in the second direction away from the casing 11. The fourth boss 22 is positioned on the axis of the second boss 16 extending in the second direction. Incidentally, the developing cartridge 1 includes a collar rotatable about the fourth boss 22 in a manner the same as the second collar 17. The second developing collar 23 extends in the second direction. The second developing collar 23 is positioned at the other end portion in the second direction of the developing roller 12. Specifically, the second developing collar 23 is positioned at another end portion in the second direction of the developing roller shaft 12*c*. The second developing collar 23 is a member separate from the developing roller 12, and is attached to the developing roller shaft 12*c*. More specifically, the second developing collar 23 is the member separate from the developing roller shaft 12*c*, and is attached to the developing roller shaft 12*c*. To be more specific, the second developing collar 23 is a hollow cylindrical member, and is fitted with the developing roller shaft 12*c*. As an alternative, the second developing collar 23 may be formed integrally with the developing roller 12. More specifically, the second developing collar 23 may be formed integrally with the developing roller shaft 12*c*. The second developing collar 23 is positioned on the axis of the first developing collar 18 extending in the second direction. As will be described in detail, the second developing collar 23 functions as a positioning member to fix the position of the developing cartridge 1 relative to the drum unit 3 in cooperation with the first developing collar 18.

Further, the drum unit 3 according to the present embodiment includes the developing cartridge holders 30 of the first side plate 33, and developing cartridge holders of the second side plate 34. Specifically, as illustrated in two dotted chain lines in FIG. 9, the developing cartridge holder 30 of the first side plate 33 and the developing cartridge holder of the second side plate 34 according to the present embodiment include a support portion 46, a pressure member 47, a lock lever 48, and the guide 49. That is, a pair of the support portions 46, a pair of the pressure members 47, a pair of the lock levers 48, and a pair of the guides 49 are provided corresponding to a pair of cartridge holders. In the following description, only the developing cartridge holder 30 of the first side plate 33 will be mainly described to avoid duplicating description.

As illustrated in FIG. 9, the support portion 46 has a support surface 41. The support portion 46 protrudes in the second direction from an inner surface of the first side plate 33. The support surface 41 faces in anti-gravitational direction. The support surface 41 is perpendicular to the first direction. The support surface 41 functions to support the first boss 13 through the first collar 14 when the developing cartridge 1 is attached to the developing cartridge holder 30. The pressure member 47 has a first pressure surface 42. The pressure member 47 is positioned at an inner surface of the first side plate 33. The first pressure surface 42 is a flat plane approximately perpendicular to the third direction. The first pressure surface 42 is slidable in the third direction. The pressure member 47 has a spring (not illustrated) as a resiliently urging member. In a case where the first pressure surface 42 moves toward another side in the third direction, the first pressure surface 42 is pressed by the spring toward one side in the third direction. the first pressure surface 42 contacts the first pressure receiving surface 15 when the developing cartridge 1 is attached to the developing cartridge holder 30. Hence, the first pressure receiving surface 15 is pressed by the first pressure surface 42 in the third direction and in the direction from another side to the one side.

The lock lever 48 is positioned at one end portion in the first direction of the first side plate 33 (the one end portion being a leading end portion of the first side plate 33 in the anti-gravitational direction). The lock lever 48 has a second pressure surface 43 and a guide surface 51. The guide surface 51 is arcuate in shape. The second pressure surface 43 is a flat plane continuous with the guide surface 51.

The lock lever 48 is pivotally movable about a pivot axis extending in the third direction between a locking position and a release position. In a case where the lock lever 48 is at the locking position, at least a part of the guide surface 51 is positioned between the first side plate 33 and the second side plate 34. In a case where the lock lever 48 is at the locking position, the second pressure surface 43 is directed approximately perpendicular to the first direction, so that the second pressure surface 43 faces another side in the first direction.

A distance between the guide surface 51 and the second side plate 34 in the second direction in a case where the lock lever 48 is at the release position is greater than the distance in a case where the lock lever 48 is at the locking position. The lock lever 48 has a spring (not illustrated) as a resiliently urging member. The spring of the lock lever 48 is configured to urge the second pressure surface 43 toward the locking position. The second pressure surface 43 contacts the second boss 16 through the second collar 17 when the developing cartridge 1 is attached to the developing cartridge holder 30.

Hence, the second boss 16 is pressed in the first direction from one side to another side by the second pressure surface 43.

The guide 49 has a first guide surface 44 and a second guide surface 45. The guide 49 is positioned at an inner side surface of the first side plate 33. The guide 49 is arcuate in shape. The first guide surface 44 is a flat plane approximately perpendicular to the first direction. The first guide surface 44 functions as a positioning surface for fixing position of the developing cartridge 1 relative to the drum unit 3 because of the contact of the first guide surface 44 with the first developing collar 18 by the pivotal movement of the developing cartridge 1 about the axis of the first boss 13 when the developing cartridge 1 is attached to the developing cartridge holder 30. At this time, the developing roller 12 approaches the photosensitive drum 31.

The second guide surface 45 includes a flat surface and a sloped surface continuous with the flat surface. The flat surface is approximately perpendicular to the first direction. The sloped surface has one end in the third direction connected to the flat surface. The sloped surface is inclined in a direction from one side to another side in the first direction toward another side in the third direction. The second guide surface 45 is positioned to face the first developing collar 18 with a space therebetween in the first direction by the pivotal movement of the developing cartridge 1 about the axis of the first boss 13 when the developing cartridge 1 is attached to the developing cartridge holder 30. At this time, the developing roller 12 approaches the photosensitive drum 31.

5. Relationship of Applied Forces in Case of Attachment of Developing Cartridge Relationship of applied forces in case of attachment of the developing cartridge 1 to the drum unit 3 will be described with reference to FIGS. 8 through 12.

For attaching the developing cartridge 1 to the drum unit 3, a user firstly directs the first end portion 113 of the casing 11 toward another side in the first direction, and directs the second end portion 114 of the casing 11 toward one side in the first direction. Then, the user inserts the developing cartridge 1 into the developing cartridge holder (the developing cartridge holder 30 of the first side plate 33 and the developing cartridge holder of the second side plate 34) in the first direction directing from the one side and another side. Hence, the first boss 13 is supported by the support surface 41 through the first collar 14. the support surface 41 being forward of the first boss 13 toward another side in the first direction. Accordingly, the weight of the developing cartridge 1 is supported by the support surface 41.

In a process of insertion of the developing cartridge 1 into the drum unit 3 in the direction from one side to another side in the first direction, the arcuate guide surface 51 is pushed by the second boss 16 (or the second collar 17), so that the guide surface 51 is smoothly pivotally moved outward of the drum unit 3 in the second direction against the urging force of the spring of the lock lever 48. Hence, the lock lever 48 is moved to the release position. Hence, the developing cartridge 1 can move past the lock lever 48 in the first direction toward another side, and the second boss 16 is positioned forward of the 48 in the first direction toward another side. Then, the second pressure surface 43 is moved inward of the drum unit 3 by the urging force of the spring of the lock lever 48, so that the lock lever 48 is moved to the locking position.

As such, as illustrated in FIG. 9, the second boss 16 (the second collar 17) contacts the second pressure surface 43, so that the second boss 16 receives pressing force from the second pressure surface 43 in the first direction directing from the second end portion 114 to the first end portion 113. At this time, since the first boss 13 is in a supported state supported by the support surface 41 from another side in the first direction, angular moment centered on the first boss 13 is applied to the developing cartridge 1. As a result, the developing cartridge 1 is slightly pivotally moved within the 3 about the axis of the first boss 13, permitting the developing roller 12 to approach the photosensitive drum 31. Pivotal movement of the developing cartridge 1 about the axis of the first boss 13 is stopped by the contact of the first developing collar 18 with the first guide surface 44. Thus, a contacting angle between the developing roller 12 and the photosensitive drum 31 is fixed. Consequently, position of the developing roller 12 relative to the photosensitive drum 31 is properly fixed. In other words, the position of the developing cartridge 1 relative to the drum unit 3 is fixed.

Further, in a process of insertion of the developing cartridge 1 into the drum unit 3 in the first direction from one side to another side, the first pressure surface 42 is pressed by the first pressure receiving surface 15, and is moved in the third direction toward another side against urging force of the spring of the pressure member 47.

At the same time when the developing cartridge 1 is slightly pivotally moved about the axis of the first boss 13 or after the slight pivotal movement of the developing cartridge 1, the first pressure receiving surface 15 receives pressing force from the first pressure surface 42 in the third direction from non-exposed surface to the exposed surface 12*a*. At this time, since the weight of the developing cartridge 1 is applied to the support surface 41 through the first boss 13, the first boss 13 (the first collar 14) is slightly moved on the support surface 41 in the third direction toward one side.

Hence, the developing roller 12 further approaches the photosensitive drum 31 whereupon the outer peripheral surface of the developing roller 12 (developing roller body) and the outer peripheral surface of the photosensitive drum 31 are brought into pressure contact with each other with a proper contacting pressure. In this case, since the weight of the developing cartridge 1 is received by the support surface 41, the weight of the developing cartridge 1 does not affect the contacting pressure between the developing roller 12 and the photosensitive drum 31. Accordingly, this prevents the contacting pressure between the photosensitive drum 31 and the developing roller 12 from being largely affected by residual amount of toner accommodated in the developing cartridge 1.

Further, the first developing collar 18 is in a nipped state where the first developing collar 18 is nipped between the first guide surface 44 and the second guide surface 45 in the first direction immediately before the contact of the outer peripheral surface of the developing roller 12 (the developing roller body) and the outer peripheral surface of the photosensitive drum 31 with each other. Hence, the developing roller 12 can be properly subjected to positioning relative to the photosensitive drum 31. Incidentally, the first developing collar 18 can be smoothly guided between the first guide surface 44 and the second guide surface 45 by the sloped surface of the second guide surface 45.

As such, the developing cartridge 1 is attached to the drum unit 3 with the state that the position of the developing cartridge 1 relative to the drum unit 3 is properly fixed. In this state, since the lock lever 48 is at the locking position, the developing cartridge 1 is not easily detached from the drum unit 3 due to vibration and impact applied to the image forming apparatus 100. In this manner, according to the present embodiment, the structure for attaching and detaching the developing cartridge 1 to and from the drum unit 3 having high reliability can be realized.

6. Separation Cam

The developing cartridge 1 according to the present embodiment includes a separation cam 80 in addition to the above described structure. In a state where the developing cartridge 1 is attached to the drum unit 3, the separation cam 80 is configured to move the developing roller 12 between a contact position where the developing roller 12 is in contact with the photosensitive drum 31 and a separated position where the developing roller 12 is separated from the photosensitive drum 31. As illustrated in FIGS. 3 through 6, the separation cam 80 includes a first cam 81, a second cam 82 and a cam shaft 83.

The cam shaft 83 is a columnar member extending in the second direction. An outer surface at one side in the third direction of the casing 11 has a groove 116 extending in the second direction.

The cam shaft 83 is positioned in the groove 116. Further, the gear cover 60 has a cam opening 63. The cam opening 63 is a through-hole extending throughout the thickness of the gear cover 60 in the second direction. The cam shaft 83 is inserted in the cam opening 63. One end portion in the second direction of the cam shaft 83 is positioned at further away from the cam opening 63 in the second direction toward one side. Another end portion in the second direction of the cam shaft 83 is positioned at another end portion in the second direction of the groove 116.

The first cam 81 is positioned at one end portion in the second direction of the cam shaft 83. Specifically, the first cam 81 is fixed to the one end portion in the second direction of the cam shaft 83. The first cam 81 has a first inclined surface 811. The first inclined surface 811 is inclined with respect to the second direction. Specifically, the first inclined surface 811 sloped to be away from the cam shaft 83 as it goes toward one side in the second direction. The first inclined surface 811 is positioned only at a partial angular region of the outer peripheral surface of the first cam 81, the partial angular region facing one side in the third direction. However, the first inclined surface 811 may be formed over an entire outer peripheral surface of the first cam 81.

The second cam 82 is positioned at another end portion in the second direction of the cam shaft 83. Specifically, the second cam 82 is fixed to the other end portion in the second direction of the cam shaft 83. The second cam 82 has a second inclined surface 821. The second inclined surface 821 is inclined with respect to the second direction. Specifically, the second inclined surface 821 is sloped to be away from the cam shaft 83 as it goes toward one side in the second direction. The second inclined surface 821 is positioned only at a partial angular region of the outer peripheral surface of the second cam 82, the partial angular region facing one side in the third direction. However, the second inclined surface 821 may be formed over an entire outer peripheral surface of the second cam 82.

The first cam 81, the second cam 82, and the cam shaft 83 are movable along with the casing 11 in the first direction and the third direction. Further, the first cam 81, the second cam 82, and the cam shaft 83 are movable relative to the casing 11 in the second direction. Specifically, the first cam 81, the second cam 82, and the cam shaft 83 are movable between a first position and a second position in the second direction, the second position being forward of the first position toward another side in the second direction.

Further, the separation cam 80 includes a resilient urging member (not illustrated) positioned at an interior of the cam opening 63. A coil spring is available as the resilient urging member. The resilient urging member is configured to urge the first cam 81, the second cam 82, and the cam shaft 83 in the direction from the second position to the first position. Accordingly, in a case where no driving force directing toward another side in the second direction is applied to the first cam 81 from the image forming apparatus 100, the first cam 81, the second cam 82, and the cam shaft 83 are positioned at the first position.

In the state where the drum unit 3 to which the developing cartridge 1 is attached is attached to the image forming apparatus 100, the first cam 81, the second cam 82, and the cam shaft 83 are moved from the first position to the second position in response to application of driving force directing in the second direction toward another side from the image forming apparatus 100 to the first cam 81. Hence, the first inclined surface 811 of the first cam 81 is brought into contact with a part of the first side plate 33 of the drum unit 3. Further, the second inclined surface 821 of the second cam 82 is brought into contact with a part of the second side plate 34 of the drum unit 3.

In accordance with further movement of the first inclined surface 811 and the second inclined surface 821 in the second direction toward another side relative to the first side plate 33 and second side plate 34, respectively, the first inclined surface 811 and the second inclined surface 821 move in the third direction toward another side relative to the drum unit 3. As a result, the separation cam 80, the casing 11, the gear cover 60, and the developing roller 12 move in the third direction toward another side relative to the photosensitive drum 31. Consequently, the developing roller 12 moves from the contacting position where the developing roller 12 is in contact with the photosensitive drum 31 to the separated position where the developing roller 12 is separated from the photosensitive drum 31.

7. Modified Embodiment

While the description has been made in detail with reference to the specific embodiment, the present disclosure is not limited to the above-described embodiment. Details of shape of the developing cartridge and the image forming apparatus may be different from the shape illustrated in each drawing. Further, each component appearing in the embodiment and the modified embodiment may be suitably combined together avoiding conflicting combination.

What is claimed is:

1. A developing cartridge comprising:

a casing configured to accommodate therein toner and extending in a first direction, the casing having a first end portion in the first direction and a second end portion remote from the first end portion in the first direction;

a developing roller rotatable about a developing axis extending in a second direction different from the first direction, the developing roller being positioned closer to the first end portion than to the second end portion in the first direction, the developing roller having:

an exposed surface positioned at one end portion in a third direction of the developing roller and exposed to an outside of the casing; and a non-exposed surface positioned at another end portion in the third direction of the developing roller and positioned inside the casing;

a developing roller gear rotatable together with the developing roller about the developing axis and positioned at one end portion in the second direction of the developing roller;

a gear cover positioned at one end portion in the second direction of the casing and covering at least a part of the developing roller gear;

a first boss positioned at an outer surface of the gear cover and extending in the second direction and movable together with the casing, the first boss being configured to support a weight of the developing cartridge, the first boss being positioned away from the developing roller in the first direction by a first distance and also positioned away from the developing roller in the third direction; and a pressure receiving surface positioned further from the developing roller than the first boss is from the developing roller in the third direction, the pressure receiving surface being positioned away from the developing roller by the first distance or by a second distance shorter than the first distance in the first direction.

2. The developing cartridge according to claim 1, further comprising:

an agitator rotatable about an agitator axis extending in the second direction, the agitator being positioned inside the casing; and an agitator gear rotatable together with the agitator about the agitator axis;

wherein the gear cover covers at least a part of the agitator gear.

3. The developing cartridge according to claim 2, wherein the first boss is overlapped with at least a part of the agitator gear in the second direction.

4. The developing cartridge according to claim 3, further comprising:

a coupling rotatable about a coupling axis extending in the second direction; and a coupling gear rotatable together with the coupling about the coupling axis;

wherein the gear cover covers at least a part of the coupling gear.

5. The developing cartridge according to claim 4, further comprising an idle gear rotatable about an idle axis extending in the second direction, the idle gear being in meshing engagement with the agitator gear and the coupling gear;

wherein the gear cover covers at least a part of the idle gear.

6. The developing cartridge according to claim 4, further comprising:

a supply roller rotatable about a supply axis extending in the second direction and in contact with the developing roller; and a supply roller gear rotatable together with the supply roller about the supply axis, the supply roller gear being positioned at one end portion in the second direction of the supply roller, and in meshing engagement with the coupling gear;

wherein the gear cover covers at least a part of the supply roller gear.

7. The developing cartridge according to claim 1, wherein the first boss extends from the outer surface of the gear cover in the second direction.

8. The developing cartridge according to claim 7, wherein the first boss extends from the outer surface of the gear cover in the second direction and away from the casing.

9. The developing cartridge according to claim 1, wherein the first boss is fixed to the outer surface of the gear cover.

10. The developing cartridge according to claim 1, wherein the developing roller comprises:

a developing roller shaft extending in the second direction; and a developing collar fitted with the developing roller shaft and positioned at the outer surface of the gear cover;

wherein the gear cover has a portion having a shaft opening allowing the developing roller shaft to be inserted therein.

11. The developing cartridge according to claim 1, further comprising a cam shaft extending in the second direction and movable relative to the casing;

wherein the gear cover has a portion having a cam opening allowing the cam shaft to be inserted therein.

12. The developing cartridge according to claim 1, further comprising a first collar rotatable about the first boss, the first collar having one of a hollow cylindrical shape and hollow polygonal shape.

13. The developing cartridge according to claim 12, wherein the first collar has an outer peripheral surface having an annular engagement groove;

wherein the gear cover comprises a pawl portion extending from the outer surface in the second direction and outward of the gear cover, the pawl portion having a tip end portion bent toward the first boss to be inserted in the annular engagement groove.

14. A developing cartridge comprising:

a casing configured to accommodate therein toner and extending in a first direction, the casing having a first end portion in the first direction and a second end portion remote from the first end portion in the first direction;

a developing roller rotatable about a developing axis extending in a second direction different from the first direction, the developing roller being positioned closer to the first end portion than to the second end portion in the first direction, the developing roller having:

an exposed surface positioned at one end portion in a third direction of the developing roller and exposed to an outside of the casing; and a non-exposed surface positioned at another end portion in the third direction of the developing roller and positioned inside the casing;

a developing roller gear rotatable together with the developing roller about the developing axis and positioned at one end portion in the second direction of the developing roller;

a gear cover positioned at one end portion in the second direction of the casing and covering at least a part of the developing roller gear;

a first boss positioned at an outer surface of the gear cover and extending in the second direction and movable together with the casing, the first boss being configured to support a weight of the developing cartridge, the first boss being positioned away from the developing roller in the first direction and the third direction; and a second boss extending in the second direction and movable together with the casing, the second boss being positioned at a first outer surface positioned at the one end portion in the second direction of the casing, the second boss being positioned further from the developing roller than the first boss is from the developing roller in the first direction and the third direction.

15. The developing cartridge according to claim 14, further comprising:

an agitator rotatable about an agitator axis extending in the second direction, the agitator being positioned inside the casing; and an agitator gear rotatable together with the agitator about the agitator axis;

wherein the gear cover covers at least a part of the agitator gear.

16. The developing cartridge according to claim 15, wherein the first boss is overlapped with at least a part of the agitator gear in the second direction.

17. The developing cartridge according to claim 16, further comprising:

a coupling rotatable about a coupling axis extending in the second direction; and a coupling gear rotatable together with the coupling about the coupling axis;

wherein the gear cover covers at least a part of the coupling gear.

18. The developing cartridge according to claim 17, further comprising an idle gear rotatable about an idle axis extending in the second direction, the idle gear being in meshing engagement with the agitator gear and the coupling gear;

wherein the gear cover covers at least a part of the idle gear.

19. The developing cartridge according to claim 17, further comprising:

a supply roller rotatable about a supply axis extending in the second direction and in contact with the developing roller; and a supply roller gear rotatable together with the supply roller about the supply axis, the supply roller gear being positioned at one end portion in the second direction of the supply roller, and in meshing engagement with the coupling gear;

wherein the gear cover covers at least a part of the supply roller gear.

20. The developing cartridge according to claim 14, wherein the first boss extends from the outer surface of the gear cover in the second direction.

21. The developing cartridge according to claim 20, wherein the first boss extends from the outer surface of the gear cover in the second direction and away from the casing.

22. The developing cartridge according to claim 14, wherein the first boss is fixed to the outer surface of the gear cover.

23. The developing cartridge according to claim 14, wherein the developing roller comprises:

a developing roller shaft extending in the second direction; and a developing collar fitted with the developing roller shaft and positioned at the outer surface of the gear cover;

wherein the gear cover has a portion having a shaft opening allowing the developing roller shaft to be inserted therein.

24. The developing cartridge according to claim 14, further comprising a cam shaft extending in the second direction and movable relative to the casing;

wherein the gear cover has a portion having a cam opening allowing the cam shaft to be inserted therein.

25. The developing cartridge according to claim 14, further comprising a first collar rotatable about the first boss, the first collar having one of a hollow cylindrical shape and hollow polygonal shape.

26. The developing cartridge according to claim 25, wherein the first collar has an outer peripheral surface having an annular engagement groove;

wherein the gear cover comprises a pawl portion extending from the outer surface in the second direction and outward of the gear cover, the pawl portion having a tip end portion bent toward the first boss to be inserted in the annular engagement groove.

* * * * *